US010169982B1

(12) United States Patent
Griffith et al.

(10) Patent No.: US 10,169,982 B1
(45) Date of Patent: Jan. 1, 2019

(54) SYSTEMS AND METHODS FOR DELAYING OR ACTIVATING A BLOWOUT DEVICE OR A PURGE DEVICE IN A SAMPLING PIPE NETWORK OF AN ASPIRATED SMOKE DETECTION SYSTEM

(71) Applicant: Honeywell International Inc., Morristown, NJ (US)

(72) Inventors: Bruce Robert Griffith, Geneva, IL (US); Edward J. Kurtz, Geneva, IL (US); Bernard Sokol, Katowice (PL)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 15/640,770

(22) Filed: Jul. 3, 2017

(51) Int. Cl.
*G08B 17/10* (2006.01)
*G08B 29/18* (2006.01)

(52) U.S. Cl.
CPC ..... *G08B 29/18* (2013.01); *G08B 17/10* (2013.01)

(58) Field of Classification Search
CPC ..... G08B 29/18; G08B 17/10; G01N 15/0205
USPC ..... 340/628, 630, 632
See application file for complete search history.

(56) References Cited

U.S. PATENT DOCUMENTS 5,326,025 A * 7/1994 Dempsey ..... F23N 5/203 236/11
2010/0271219 A1* 10/2010 Lang ..... G08B 17/10 340/628
2015/0161865 A1* 6/2015 Susel ..... G01N 1/26 340/628
2015/0253165 A1* 9/2015 Ajay ..... G01F 1/66 73/28.01
2016/0086468 A1* 3/2016 Calvert ..... G08B 17/10 340/628
2016/0116389 A1* 4/2016 Cooper ..... G08B 17/10 356/340

* cited by examiner

*Primary Examiner* — Tai T Nguyen
(74) *Attorney, Agent, or Firm* — Husch Blackwell LLP

(57) ABSTRACT

Systems and methods for delaying or activating a blowout device in a sampling pipe network of an aspirated smoke detection system are provided. Some systems can include an aspirated smoke detector, a sampling pipe coupled to the aspirated smoke detector, a blowout device coupled to the sampling pipe, and a delay device coupled to the blowout device. Responsive to the aspirated smoke detector detecting a triggering event, the delay device can delay the blowout device from performing a blowout action in the sampling pipe or can instruct the blowout device to perform the blowout action in the sampling pipe.

15 Claims, 3 Drawing Sheets

SYSTEMS AND METHODS FOR DELAYING OR ACTIVATING A BLOWOUT DEVICE OR A PURGE DEVICE IN A SAMPLING PIPE NETWORK OF AN ASPIRATED SMOKE DETECTION SYSTEM

FIELD

The present invention relates generally to a smoke detection system. More particularly, the present invention relates to systems and methods for delaying or activating a blowout device or a purge device in a sampling pipe network of an aspirated smoke detection system.

BACKGROUND

In all environments, with the exception of a clean room, a sampling pipe network of an aspirated smoke detection system will experience accumulated particulate and contaminants, such as dust, in sampling holes of pipes in the network and inside of the pipes themselves. Such accumulated particulate and contaminants can restrict the flow of air within the pipes and eventually cause a low flow fault event in the aspirated smoke detection system.

Accordingly, it is known to activate a blowout device or a purge device in the sampling pipe network, for example, in harsh, dirty, or heavy particulate ridden environments, to perform a blowout action or a purge action that includes sending compressed air through one or more of the pipes in a direction that is opposite to the normal direction of airflow in the pipes. Such blowout devices or purge device performing such blowout actions or purge actions can effectively clear the pipes and any sampling holes therein of any accumulated particulate and contaminants. Indeed, purging the pipes of accumulated particulate and contaminants early and often can increase the effectiveness of the blowout device, the purge device, the blowout action, and the purge action because, over time, the accumulated particulate and contaminants can become attached to the pipes, most notably in humid environments, thereby making them more difficult to remove. Furthermore, purging the pipes of accumulated particulate and contaminants early and often can reduce or avoid low flow fault events.

However, problems can arise when the blowout device or the purge device is activated at regularly scheduled activation intervals, for example, daily, and performs the blowout action or the purge action when smoke is located in any of the pipes in the network. Indeed, if the blowout device or the purge device clears the pipes of any such smoke, the transport time of the smoke within the pipes can be delayed, and the aspirated smoke detection system can be delayed or inaccurate in detecting the smoke and transmitting signals indicative thereof.

In view of the above, there is a continuing, ongoing need for improved systems and methods.

DETAILED DESCRIPTION

Figure 1:
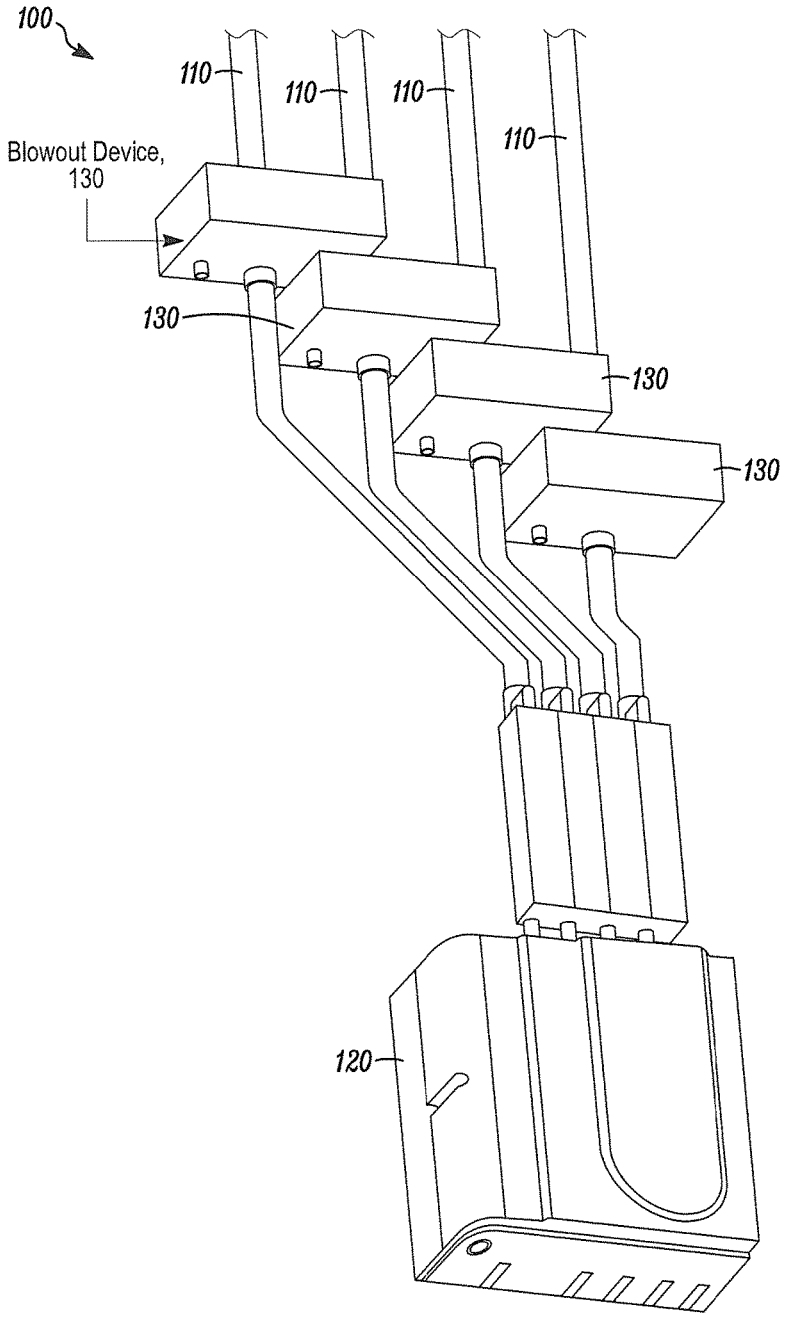
FIG. 1 is a perspective view of a system in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include systems and methods for delaying or activating a blowout device or a purge device in a sampling pipe network of an aspirated smoke detection system. For example, in accordance with disclosed embodiments, systems and methods disclosed herein can include an isolation delay device that can prevent the blowout device or the purge device from activating and from performing a blowout action or a purge action while the aspirated smoke detection system is experiencing or detecting a triggering event or that can instruct the blowout device or the purge device to activate and perform the blowout action or the purge action responsive to the aspirated smoke detection system experiencing or detecting the triggering event. In some embodiments, the isolation delay device disclosed herein can include a relay device, and in some embodiments, the isolation delay device disclosed herein can be a programmable, air solenoid operated device. Furthermore, in some embodiments, the blowout device or the purge device can be associated with a self-contained air source that the blowout device or the purge device can access to perform the blowout action or the purge action.

In some embodiments, systems and methods disclosed herein can delay the blowout device or the purge device from activating and performing the blowout action or the purge action for a predetermined period of time. After expiration of the predetermined period of time, the blowout device can be activated and perform the blowout action or the purge action immediately or in accordance with a regularly scheduled activation interval.

In some embodiments, systems and methods disclosed herein can delay the blowout device or the purge device from activating and performing the blowout action or the purge action until the aspirated smoke detection system no longer detects the triggering event at which time the blowout device or the purge device can be activated and perform the blowout action or the purge action immediately or in accordance with a regularly scheduled activation interval. In some embodiments, the time until the aspirated smoke detection system no longer detects the triggering event can be an indefinite period of time.

In some embodiments, when pipes in the sampling pipe network become dirty enough due to accumulated particulate and contaminants that have not been cleared via the blowout action or the purge action, for example, because the aspirated smoke detection system continues to detect the triggering event and because the blowout device or the purge device is not activated, the aspirated smoke detection system can detect a low flow fault event, for example, when the accumulated particulate causes airflow in the pipes to fall below a predetermined level.

FIG. 1 is a perspective view of a system 100 in accordance with disclosed embodiments. As seen in FIG. 1, the system 100 can include a plurality of pipes 110 of a sampling pipe network coupled to an aspirated smoke detector 120. A respective one of a plurality of blowout devices 130 can be coupled to each of the plurality of pipes 110 to perform the blowout action as disclosed herein. It is to be understood that the blowout devices 130 shown within the plurality of pipes 110 in FIG. 1 are exemplary only and that the location of the blowout devices 130 within the plurality of pipes is not a limitation of the embodiments disclosed herein. Instead, the blowout devices 130 could be located within the middle of or at either end of the plurality of pipes 130.

Figure 2:
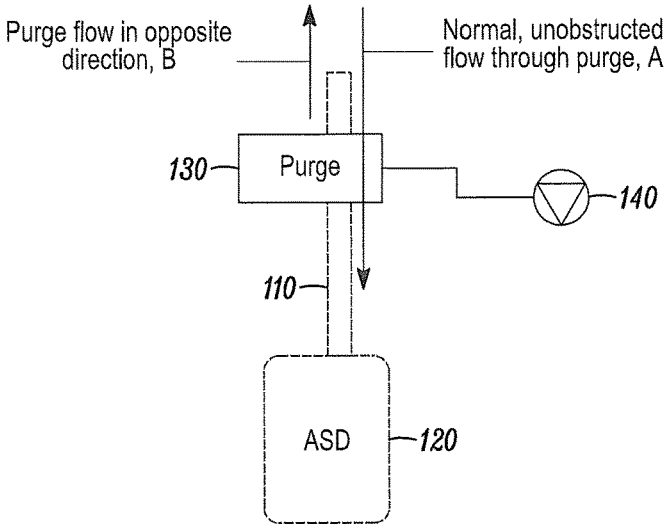
FIG. 2 is a block diagram of one of the plurality of pipes, the aspirated smoke detector, and one of the plurality of blowout devices of the system of FIG. 1.

FIG. 2 is a block diagram of one of the plurality of pipes 110, the aspirated smoke detector 120, and one of the plurality of blowout devices 130 of the system 100 of FIG. 1. As seen in FIG. 2, in normal operation, air can flow through the pipe 110 unobstructed in a first direction A. However, the blowout device 130 can be coupled to a delay device 140 and receive an activation signal or a delay signal from the aspirated smoke detector 120 or the delay device 140 with instructions for performing the blowout action that sends compressed air through the pipe 110 in a second direction B that is opposite the first direction A.

In some embodiments, when the triggering event occurs, the aspirated smoke detector 120 can transmit a triggering event signal to the blowout device 130, and, responsive thereto, the blowout device 130 can transmit a delay signal to the delay device 140 to prevent or delay the delay device 140 from transmitting the activation signal to the blowout device 130. Additionally or alternatively, in some embodiments, when the triggering event occurs, the aspirated smoke detector 120 can transmit the triggering event signal directly to the delay device 140, and, responsive thereto, the delay device 140 can either abstain from or delay transmitting the activation signal to the blowout device 130 or can transmit a delay signal to the blowout device 130 instructing the blowout device 130 to delay activation. Additionally or alternatively, in some embodiments, when the triggering event occurs, the aspirated smoke detector 120 can transmit the triggering event signal to the delay device 140, and, responsive thereto, the delay device 140 can transmit the activation signal to the blowout device 130. Additionally or alternatively, in some embodiments, when the triggering event occurs, the aspirated smoke detector 120 can transmit the activation signal directly to the blowout device 130.

In some embodiments, the triggering event as disclosed herein can include a smoke event, an alert event, or an alarm event, for example, the aspirated smoke detector 120 detecting an increased smoke signal caused by obscuration in the pipe 110. Responsive thereto, systems and methods can transmit the delay signal to the delay device 140 or the blowout device 130 or delay transmitting the activation signal to the blowout device 130 to delay the blowout action.

Additionally or alternatively, in some embodiments, the triggering event as disclosed herein can include the aspirated smoke detector 120 detecting a predetermined level of particulate within the pipe 110 that indicates an environmental quality that warrants purging. Responsive thereto, systems and methods can transmit the activation signal to delay device 140 or the blowout device 130 to instruct the blowout device 130 to perform the blowout action.

Additionally or alternatively, in some embodiments, the triggering event as disclosed herein can include the aspirated smoke detector 120 receiving a sensor signal from an endcap sensor associated with the pipe 110 that indicates pipe cleanliness that warrants purging. Responsive thereto, systems and methods can transmit the activation signal to delay device 140 or the blowout device 130 to instruct the blowout device 130 to perform the blowout action.

Additionally or alternatively, in some embodiments, the triggering event as disclosed herein can include the aspirated smoke detector 120 detecting a predetermined level of air flow velocity or volumetric rate within the pipe 110 that indicates a decrease caused by pipe soiling that warrants purging. Responsive thereto, systems and methods disclosed herein can transmit the activation signal to the delay device 140 or the blowout device 130 to instruct the blowout device 130 to perform the blowout action. In some embodiments, systems and methods can measure the air flow velocity or the volumetric rate within the pipe 110 within a predetermined period of time after the blowout action, and if there is no improvement in the air flow velocity or the volumetric rate, then systems and methods disclosed herein can transmit a re-activation signal to the blowout device 130 to perform a re-blowout action with increased purge pressure.

Additionally or alternatively, in some embodiments, the triggering event disclosed herein can include the aspirated smoke detector 120 receiving a foreign material signal indicative of a foreign material lodged within the pipe 110 or sampling holes therein. In these embodiments, when the triggering event occurs, the aspirated smoke detector 120 can transmit the triggering event signal and a dislodge signal to delay device 140 or the blowout device 130, and, responsive thereto, the blowout device 130 can transmit high frequency air pulses through the pipe 110 in an attempt to dislodge the foreign material.

Additionally or alternatively, in some embodiments, the triggering event disclosed herein can include a background signal of the aspirated smoke detector exceeding a predetermined level that warrants purging. Responsive thereto, systems and methods can transmit the activation signal to the delay device 140 or the blowout device 130 to instruct the blowout device 130 to perform the blowout action.

In some embodiments, when the aspirated smoke detector 120 detects a smoke event immediately after or within a predetermined period of time after the blowout action, systems and methods disclosed herein can reduce any delays in activating the blowout device 130 or raise the level at which the aspirated smoke detector 120 detects the triggering event.

In some embodiments, to compensate for the delay in the transport time of air within the pipe, systems and methods disclosed herein can temporarily increase the speed of a fan associated with the pipe 110 for a predetermined period of time after the blowout action or can temporarily raise the level at which the aspirated smoke detector 120 detects triggering event.

In some embodiments, systems and methods disclosed herein can create or access an event log in a database device that identifies when past triggering occurred. Based on the event log, systems and methods disclosed herein can activate the blowout device 130 to perform the blowout action only at times when the triggering events are not historically common. For example, in some embodiments, systems and methods disclosed herein can base a purge schedule for the blowout device 130 on the event log.

In some embodiments, systems and methods disclosed herein can create or access a flow rate log in a database device that identifies past flow rate values. Based on the flow rate log, systems and methods disclosed herein can identify a purge frequency for the blowout device 130 and increase the purge frequency when the flow rate log indicates improvement in flow rate values.

Figure 3:
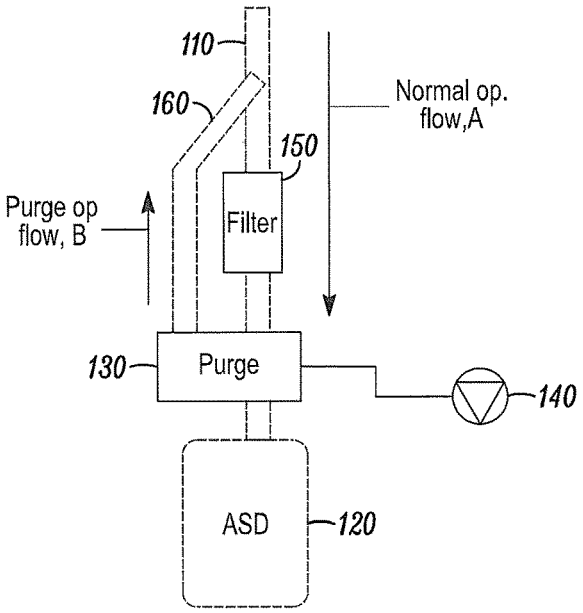
FIG. 3 is a block diagram of one of the plurality of pipes, the aspirated smoke detector, and one of the plurality of blowout devices of the system of FIG. 1 with an in-line filter and a valve in accordance with disclosed embodiments.

FIG. 3 is a block diagram of one of the plurality of pipes 110, the aspirated smoke detector 120, and one of the plurality of blowout devices 130 of the system 100 of FIG. 1 with an in-line filter 150 and a valve 160 in accordance with disclosed embodiments. As seen in FIG. 3, in some embodiments, the in-line filter 150 can be associated with the pipe 110 and located upstream of the blowout device 130 in the pipe 110, and the valve 160 can provide an alternate path pipe for the compressed air that the blowout device 130 transmits in the second direction B during the blowout action. Without the valve 160, the filter 150 could not otherwise be placed upstream of the blowout device 130 because the filter 150 would provide an obstruction to the compressed air flowing in the second direction B during the blowout action and, thus, would be damaged.

Figure 4:
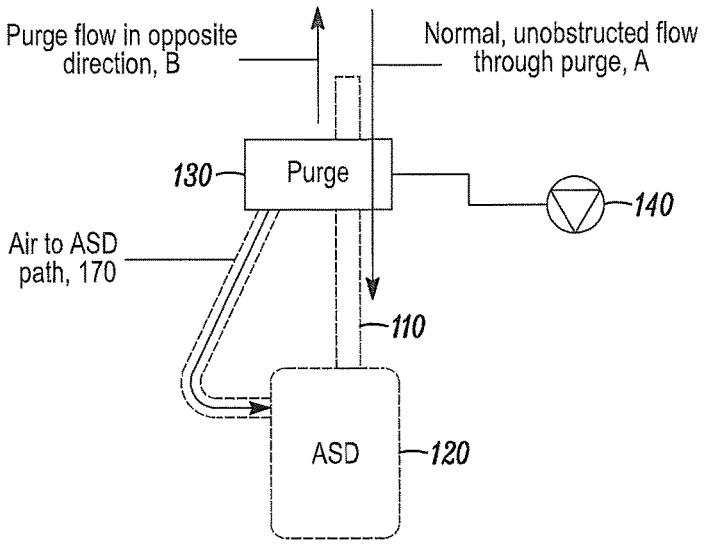
FIG. 4 is a block diagram of one of the plurality of pipes, the aspirated smoke detector, and one of the plurality of blowout devices of the system 100 of FIG. 1 with a compressed air path pipe from the blowout device to the aspirated smoke detector in accordance with disclosed embodiments.

FIG. 4 is a block diagram of one of the plurality of pipes 110, the aspirated smoke detector 120, and one of the plurality of blowout devices 130 of the system 100 of FIG. 1 with a compressed air path pipe 170 from the blowout device 130 to the aspirated smoke detector 120 in accordance with disclosed embodiments. In addition to or as an alternative to any of the embodiments disclosed herein, when the triggering event as disclosed herein occurs, for example, when the background signal of the aspirated smoke detector exceeds a predetermined level that warrants purging, the blowout device 130 can perform the blowout action in the compresses air path pipe 170 by transmitting high velocity compressed air to the aspirated smoke detector 120 via the compressed air path pipe 170 to clear the aspirated smoke detector 120 or specific areas thereof of accumulated particulate and contaminants.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A system comprising:

an aspirated smoke detector;

a sampling pipe coupled to the aspirated smoke detector;

a blowout device coupled to the sampling pipe; and a delay device coupled to the blowout device, wherein, responsive to the aspirated smoke detector detecting a triggering event, the aspirated smoke detector transmits a triggering event signal to the blowout device, wherein, responsive to the blowout device receiving the triggering event signal, the blowout device transmits a delay signal to the delay device, and wherein, responsive to the aspirated smoke detector receiving the delay signal, the delay device delays the blowout device from performing a blowout action in the sampling pipe by delaying transmission of an activation signal to the blowout device.

2. The system of claim 1 wherein the delay device delays the blowout device from performing the blowout action in the sampling pipe for a predetermined period of time.

3. The system of claim 1 wherein the delay device delays the blowout device from performing the blowout action in the sampling pipe while the aspirated smoke detector detects the triggering event.

4. The system of claim 1 wherein the triggering event includes the aspirated smoke detector detecting a smoke event, an alert event, an alarm event, or an increased smoke signal associated with the sampling pipe.

5. The system of claim 1 further comprising a fan coupled to the sampling pipe, wherein the aspirated smoke detector increases a speed of the fan for a predetermined period of time after the blowout device performs the blowout action in the sampling pipe.

6. The system of claim 1 wherein the delay device activates the blowout device to perform the blowout action in the sampling pipe according to a blowout schedule, and wherein the blowout schedule is based on an event log or a flow rate log.

7. The system of claim 1 further comprising:

an in-line filter coupled to the sampling pipe and located upstream of the blowout device in the sampling pipe;

a valve coupled to the blowout device; and an alternate flow path pipe coupled to the valve and to the sampling pipe, wherein the blowout action includes the blowout device activating the valve and sending compressed air to the sampling pipe via the alternate flow path pipe while avoiding the in-line filter.

8. A system comprising:

an aspirated smoke detector;

a sampling pipe coupled to the aspirated smoke detector;

a blowout device coupled to the sampling pipe; and a delay device coupled to the blowout device, wherein, responsive to the aspirated smoke detector detecting a triggering event, the aspirated smoke detector transmits a triggering event signal to the delay device, and wherein, responsive to the delay device receiving the triggering event signal, the delay device transmits an activation signal to the blowout device to instruct the blowout device to perform a blowout action in the sampling pipe.

9. The system of claim 8 wherein the triggering event includes the aspirated smoke detector detecting a predetermined level of particulate, air flow velocity, or volumetric rate within the sampling pipe that warrants purging.

10. The system of claim 9 wherein, responsive to the predetermined level of the particulate, the air flow velocity, or the volumetric rate within the sampling pipe after the blowout device performs the blowout action in the sampling pipe, the delay device instructs the blowout device to perform a re-blowout action in the sampling pipe.

11. The system of claim 8 wherein the triggering event includes the aspirated smoke detector receiving a sensor signal from an endcap sensor associated with the sampling pipe that identifies a pipe cleanliness level that warrants purging.

12. The system of claim 8 wherein the triggering event includes the aspirated smoke detector receiving a foreign material signal indicative of a foreign material lodged within the sampling pipe or a sampling hole thereof.

13. The system of claim 8 further comprising a compressed air path pipe coupled between the blowout device and the aspirated smoke detector, wherein responsive to the aspirated smoke detector detecting the triggering event, the delay device instructs the blowout device to perform the blowout action in the compressed air path pipe to clear the aspirated smoke detector of accumulated particulate.

14. The system of claim 8 wherein the activation signal includes a delay signal instructing the blowout device to delay performing the blowout action in the sampling pipe for a predetermined time.

15. A method comprising:

during normal operation of an aspirated smoke detection system, sampling air flowing through a sampling pipe in a first direction;

during blowout operation of the aspirated smoke detection system, a blowout device sending compressed air through the sampling pipe in a second direction, wherein the second direction is opposite the first direction;

responsive to the aspirated smoke detection system detecting a triggering event, the aspirated smoke detection system transmitting a triggering event signal to a delay device;

responsive to the delay device receiving the triggering event signal, the delay device transmitting an activation signal to the blowout device, the activation signal instructing the blowout device to send the compressed air through the sampling pipe.

* * * * *